United States Patent [19]

Masini

[11] 4,321,806

[45] Mar. 30, 1982

[54] METHOD AND APPARATUS FOR OPENING THE LATCH OF THE NEEDLES IN DOUBLE-CYLINDER KNITTING MACHINES

[76] Inventor: Martino Masini, Via Sandrini 14, Quinzano d'Oglio (Brescia), Italy

[21] Appl. No.: 163,904

[22] Filed: Jun. 27, 1980

[30] Foreign Application Priority Data

Nov. 7, 1979 [IT] Italy ..... 5193 A/79

[51] Int. Cl.[3] ..... D04B 9/10; D04B 15/08; D04B 15/10

[52] U.S. Cl. ..... 66/14; 66/111; 66/115

[58] Field of Search ..... 66/14, 63, 111, 115

[56] References Cited

U.S. PATENT DOCUMENTS

| | | | |
|---|---|---|---|
| 1,899,278 | 2/1933 | Lawson et al. | 66/115 |
| 2,375,475 | 5/1945 | Holmes et al. | 66/14 |
| 3,283,539 | 11/1966 | Peberdy | 66/14 |

FOREIGN PATENT DOCUMENTS

| | | | |
|---|---|---|---|
| 682410 | 10/1939 | Fed. Rep. of Germany | 66/115 |
| 853326 | 10/1952 | Fed. Rep. of Germany | 66/14 |
| 22102 | of 1912 | United Kingdom | 66/14 |

*Primary Examiner*—Wm. Carter Reynolds

[57] ABSTRACT

In a double cylinder knitting machine the grooves in which the needles and the sliders are displaced are provided with corner edges on which the latch of the needle rests. Prior to hooking the needles onto their respective sliders and while the needles are displaced axially toward the interior of their respective grooves, the shoulders engage and force the latch to rotate to the open position.

7 Claims, 5 Drawing Figures

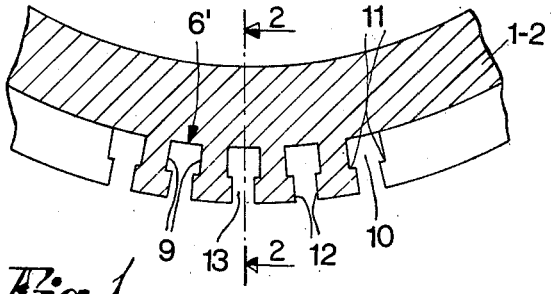
Fig. 1
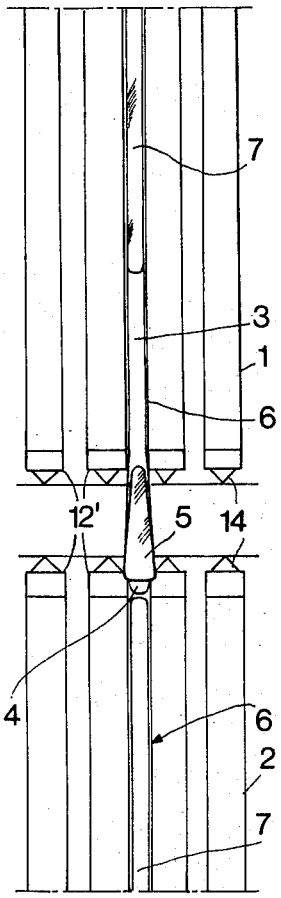
Fig. 4
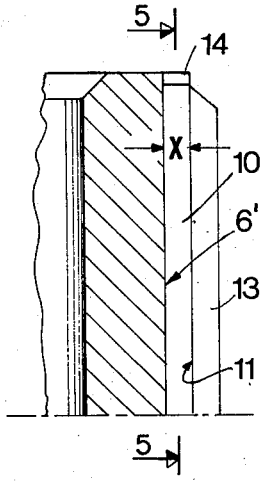
Fig. 2
Fig. 3
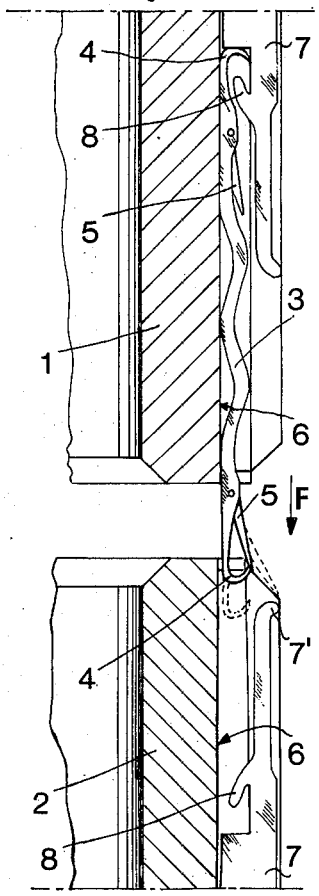
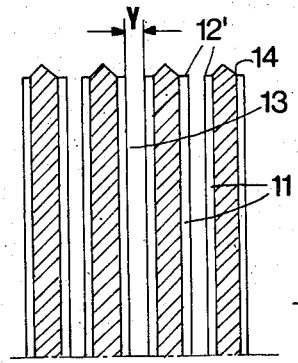
Fig. 5

METHOD AND APPARATUS FOR OPENING THE LATCH OF THE NEEDLES IN DOUBLE-CYLINDER KNITTING MACHINES

FIELD OF THE INVENTION

The present invention relates, generally, to double-cylinder knitting machines and, more particularly, to a method for opening the latches of the needles thereof when these needles are transferred from one cylinder to the other during certain types of knitting operations.

BRIEF DESCRIPTION OF THE PRIOR ART

In known and conventional double-cylinder knitting machines, for example for knitting socks and sweaters, which machines employ needles having two beaks opposed to each other and provided with relative latches, the needles may be transferred from one cylinder to the other by means of the so-called "sliders" positioned within the same grooves as the needles and having a hooked portion for hooking the beaks of the needles during the displacement of the latter in their respective grooves. In order to become engageable, the beaks of the needles must be reliably openable and, therefor, the respective latches must be moved into an open position. This, however, does not always occur in practice, especially if at the beginning of a knitted article there are not stiches on the needles to be transferred from one cylinder to the other. The task of opening the latches of the needles is entrusted, as it is conventional, to the transfer sliders. These are provided for this purpose with a tab acting on the latch of the needle to flip it to the open position when the slider is moved toward the needle for proper engagement.

Such an arrangement, however, suffers from wearing of the contacting members and from frequent breakage of the latches.

To eliminate these drawbacks, transfer sliders are used having a special structural configuration and, while on the one hand the sliders are engaged by spring-loaded means for properly aligning them in the grooves, on the other hand the entrances to said grooves are bevelled so as to guide the needles toward their respective sliders.

However, even with such arrangements the problem is not solved because the needles still have the ability of both lateral and radial displacements in their respective grooves, so that it is possible to fail in perfectly aligning the needles with the transferring sliders. In this case, it is easy to see that the action of opening the latches ot the needles on the part of the sliders' tabs is also jeopardized.

BRIEF SUMMARY OF THE INVENTION

It is therefore an object of the present invention to provide a double-cylinder knitting machine and a method which allow a reliable opening of the latches of the needles to be transferred from one cylinder to the other, even independently of the action of the tabs of the sliders, the tabs at best limiting their function to completing the opening of the latches.

It is another object of the invention to provide for a more correct guide of the needles in their grooves, so as to limit the possibility of lateral or radial outward undesirable displacement.

Briefly stated, the double-cylinder knitting machine of the invention is characterized in that on the two opposed sides of each groove for guiding the needle and its relative slider there is provided, toward the bottom of the groove itself, a pair of recesses or sockets, one on each side and opposed to each other and defining a sliding chamber for the needle. Furthermore, at the entrance of the above-mentioned groove there are two corner edges opposed to each other and spaced from each other by an amount smaller than the distance between the surfaces of the above-mentioned recesses. The corner edges are thus spaced from each other by an amount smaller than the width of the latch and, with respect to the bottom of the groove, by an amount slightly smaller than the diameter of the beak of the needle.

As to the method of the present invention, just before engaging and hooking the needles to the respective sliders, the latch of each needle rests on two corner edges or shoulders provided on opposite sides of the groove of the cylinder in which the needle is to be from time to time transferred. This occurrance causes the shoulders to force the latch to rotate into opening position when the needle is displaced axially toward the inside of the said groove.

BRIEF DESCRIPTION OF THE DRAWINGS

These and other objects of the invention will become apparent from the following detailed description of the embodiments thereof in conjunction with the accompanying illustrative, but not limitative, drawings, in which:

FIG. 1 is an enlarged, partial, sectional, transverse view of one cylinder of a double-cylinder knitting machine;

FIG. 2 is a radial, sectional view taken along arrows 2—2 of FIG. 1;

FIG. 3 is a partial, longitudinal, sectional view of the two cylinders with a needle in phase of transfer from one cylinder to the other, in the direction of arrow F;

FIG. 4 is a front elevational view of the assembly of FIG. 3; and

FIG. 5 is a partial sectional view taken along arrows 5—5 of FIG. 2.

DETAILED DESCRIPTION OF THE INVENTION

Referring to the accompanying drawings, upper cylinder 1 and lower cylinder 2 of a double-cylinder knitting machine are shown. The cylinders employ needles 3 of the type shown in FIGS. 3 and 4, that is having two beaks 4 at their opposed extremities and two latches 5 for opening and closing the beaks, during the knitting of the stitches. Each needle 3 is positioned in its respective groove 6 and can be transferred from the groove of a cylinder 1 to the corresponding groove of the other cylinder 2, and vice versa. This is effected by means of sliders 7, each having a hook 8 for the purpose of hooking a beak of the needle.

According to the invention, on each of the opposed sides of each groove 6 and adjacent the bottom of the groove 6' there is a recess or socket 9. The recess of one side faces the recess of the opposite side, so as to define therebetween a chamber 10 within which needle 3 is guided and is able to move. The recesses 9 define also a pair of corresponding shoulders 11 which are radially spaced from the bottom wall 6' of groove 6. As a continuation of the shoulders there are two opposed surfaces 12 between which the slider is guided, these two surfaces 12 defining a seat 13 having a width smaller than the width of chamber 10.

Essentially, distance x of shoulders 11 from the bottom wall 6' of the groove is at least slightly smaller than the maximum diameter of beak 4 of needle 3, so that the tip of the beak might extend in the seat 13 defined by surfaces 12. In turn, the width Y of seat 13 is slightly greater than the tip of beak 4 of the needle, but at the same time smaller than the width of the latch 5 associated to the beak, in order to permit the latch—when in closed position during the transfer of the needle—to rest against the corner edges 12' at the extremities of surfaces 12.

It is to be observed, finally, that at the entrance of each groove 6 of each cylinder 1, 2 there are provided bevels 14, aligned with the recesses 9, while the corner edges 12' for engagement with the latches 5 are inclined toward the periphery of the cylinder, starting from the base of the bevels 14.

From the above description, it can be seen that when a needle 3 is transferred—e.g.—from the upper to the lower cylinder (see FIGS. 3 and 4) and the latch 5 is closed on the lower beak 4 of the needle, as the needle is displaced toward the interior of the groove of the lower cylinder, one achieves the resting of the latch 5 upon the corner edges 12'. In this manner, the latch is forced to open while the needle advances in its respective groove. The complete opening of the latch 5 and the passage of the open latch 5 to the chamber 10 may be accomplished then by the tab' of the lower slider 7, as shown in dotted outline in the lower portion of FIG. 3 which in turn is displaced, in manner conventionally known per se, toward the needle until the lower beak is hooked and the transfer of the needle from the upper cylinder 1 to the lower one 2 is completed. The same operation takes place when the needle is transferred in the opposite sense by the corner edges 12' of the upper cylinder and by the slider of the upper cylinder.

In any event, one will always obtain a reliable opening of the latches of the needles on the part of stationary means, i.e. by the corner edges 12', positioned at the entrance of the grooves and independently of the action of the sliders, which sliders at best may limit their function to the mere completion of the opening of the latches. It follows that it is possible to advantageously eliminate the use of special sliders, since the same type of sliders may be employed also for different sizes of needles, because their use is not dependent on the opening of the latches.

The structure with two diverse sections of each groove allows, furthermore, a more correct guiding of the needle, reducing the possibility of lateral and radial deviations. Concurrently, the sliders and the needles will always be aligned for a correct cooperation, thus eliminating unnecessary wear and tear or breakages.

What I claim is:

1. A double-cylinder knitting machine having a plurality of grooves on each cylinder thereof, each groove being defined by two opposed side walls and a bottom wall and including an entrance for receiving a needle, the knitting machine further including means for opening the latches of the respective two-beak needles during the transfer thereof from one cylinder to the other by means of sliders, characterized by having on the two opposed sides of each groove (6) for guiding a needle and a slider, and adjoining the bottom wall (6'), two recesses (9) opposed to each other and defining a chamber (10) for sliding of the needle; and further characterized by having the surfaces (12) of said sides that are radially outward of the axes of the cylinders defining a sliding seat for the slider; and further characterized in that toward the entrance of said groove said surfaces form two corner edges (12') on which rests the latch of the needle for its own opening during the displacement of the needle toward the interior of the said groove.

2. The machine according to claim 1, wherein said recesses (9) define with said surfaces (12) two shoulders (11) radially spaced outwardly from the rotational axis of the respective cylinder and from the bottom wall of the groove by a dimension slightly smaller than the maximum diameter of each said beak of the needle, so that the tip of each said beak extends partly in the seat (13) defined by said surfaces.

3. The machine according to claim 1 or 2, wherein the dimension between said two surfaces (12) and their respective corner edges (12') is greater than the width of the beak of the needle, and smaller than the width of the latch associated to said beak.

4. The machine according to claim 1, wherein said corner edges (12') are inclined toward the outside of each cylinder, starting from the entrance of the respective groove.

5. The machine according to claim 1, wherein at the entrance of each groove, there are provided bevels (14).

6. Method for opening the latches of the needles of a multi-grooved double-cylinder knitting machine employing two-beak needles which are transferrable from the grooves of one cylinder to the grooves of the other cylinder by means of sliders, characterized in that, just prior to hooking the needles onto the respective sliders, the latch of each needle rests upon two corner edges or shoulders (12') provided on opposed sides and at the entrance of the respective groove to which the needle is to be transferred, so that said shoulders force the latch to rotate to the open position, while the needle is displaced axially toward the interior of said groove.

7. The method according to claim 6, wherein the opening of the latches of the needles is determined by shoulders (12') integral with or attached to the cylinder and positioned at the sides of the grooves for guiding the needles, so as to interfere with said latches during the transfer of the needles in said grooves.

* * * * *